US006572068B1

(12) United States Patent
Wai

(10) Patent No.: US 6,572,068 B1
(45) Date of Patent: Jun. 3, 2003

(54) TREE STAND

(75) Inventor: Cheng Chung Wai, Shatin (HK)

(73) Assignee: Polytree (Hong Kong) Co. Ltd. (HK)

( * ) Notice: Subject to any disclaimer, the term of this patent is extended or adjusted under 35 U.S.C. 154(b) by 0 days.

(21) Appl. No.: 09/973,172

(22) Filed: Oct. 9, 2001

(51) Int. Cl.[7] ..... A47G 33/12; F16M 13/00

(52) U.S. Cl. ..... 248/523; 248/519; 248/166; 248/188.7

(58) Field of Search ..... 248/519, 523, 248/166, 177, 188.7; 403/348, 349, 350

(56) References Cited

U.S. PATENT DOCUMENTS 4,159,096 A * 6/1979 Chase ..... 248/188.7
4,288,052 A * 9/1981 Scott ..... 248/158
4,571,882 A * 2/1986 Capen ..... 248/524
5,014,461 A * 5/1991 von Braucke et al. ..... 248/523
5,035,398 A * 7/1991 Chiang ..... 248/674
5,290,004 A 3/1994 Frost et al.
5,527,010 A * 6/1996 Kao ..... 248/188.7
5,869,151 A * 2/1999 Chong ..... 211/196
6,138,977 A * 10/2000 Tsai ..... 248/523

* cited by examiner

*Primary Examiner*—Leslie A. Braun
*Assistant Examiner*—Deborah M. Brann
(74) *Attorney, Agent, or Firm*—Salzman & Levy

(57) ABSTRACT

A collapsing tree stand having a compact construction with an improved center of gravity and elongated folding legs. The legs of the tree stand are each broadened in width at their fold-up pivot point and then tapered to a narrower width at their distal ends. This taper provides an improved center of gravity about the base, thus reducing the tendency of the tree to tip over. The legs are sufficiently elongated to provide good balance in their extended position.

9 Claims, 10 Drawing Sheets

TREE STAND

FIELD OF THE INVENTION

The present invention relates to tree stands and, more particularly, to an ornamental tree stand that folds upon itself to provide ease of storage.

BACKGROUND OF THE INVENTION

Collapsible or folding tree stands are well known in the art as illustrated in the U.S. Pat. No. 5,290,004, issued to Frost et al on Mar. 1, 1994 entitled COLLAPSIBLE CHRISTMAS TREE STAND. This prior art tree stand has two pairs of legs that fold upon themselves in a horizontal plane for storage. The problem with this tree stand, however, is that a large horizontal profile is presented in the folded state. This horizontal profile defeats the purpose of providing compactness for storage. In addition, the legs of this patented tree stand are poorly constructed, comprising light tubular elements that do not provide a weighted center of gravity. As a result, it is possible to tip over an inserted tree that is disposed in the stand.

The present invention reflects the discovery that a better solution for a fold-up tree stand should include: (a) a rigid, weighted construction for providing a lower center of gravity, and (b) a collapsible design that provides a more compact, minimized profile than that shown in the aforementioned patent.

Providing a collapsible feature for any workable tree stand almost thwarts the purpose of providing a rugged construction. The two concepts are almost diametrically opposite in purpose. This is so because elements of the stand that are thickened usually become more difficult to fold upon themselves.

The current invention is a fold-up tree stand that is weighted, rugged, and presents a more compact profile. This has been achieved by using a solid leg construction. Each leg has been broadened and thickened in width, thus providing an improved center of gravity. In addition, each leg of the stand is designed to individually collapse in a vertical plane disposed about its upright axis, thus providing a more compact structure. The vertically collapsible design provides little bulk despite the reinforcement of the leg members.

SUMMARY OF THE INVENTION

In accordance with the present invention, there is featured a collapsible tree stand. The fold-up design of the tree stand provides a solid, compact construction having an improved center of gravity and a vertical collapsing profile for ease of storage. The tree stand comprises a hollow, cylindrical base for supporting a trunk of a severed tree. A number of looped thumbscrews are disposed about and are threaded through the cylindrical base to capture the inserted, severed tree trunk. The bottom of the cylindrical base comprises three or four integrally spaced flange members that are disposed in a triangular or cross pattern about the base (i.e., at one hundred twenty or ninety degrees around the circumference, respectively).

The legs are each pivotally pinned to a respective flange member. Each of the legs comprises a locking tab disposed opposite its pivot. The stand is pivotally operative between a first, fold-up vertical position and a second, horizontally extended, operative position. In the first, fold-up position (used for storage purposes), each locking tab is projected outwardly a short distance from the base in a radial manner. In the extended, operative position, each of the locking tabs fits flush with the outer surface of the hollow, cylindrical base.

A cylindrical collar is disposed about the cylindrical base. The cylindrical collar is free to move along a vertical axis of the base in order to ride over and capture the locking tabs when the legs are in the second, horizontally extended position. In the captured state, the locking tabs prevent the legs from pivoting back to their first, fold-up position. The cylindrical collar contains apertures and adjacent lands that are disposed about an inner, annular surface disposed adjacent the outer surface of the cylindrical base. The cylindrical collar is free to rotate about the cylindrical base between a first, unlocked tab position and a second, locked tab position.

The legs are pivoted to their extended, operative position to form a stable cross or triangular patterned pedestal when a tree is to be inserted into the hollow portion of the cylindrical base. In this position, the collar is vertically placed over the locking tabs and the tabs enter the inner apertures in the collar. The collar is then turned approximately a sixteenth of a full turn to bring the lands in contact with the tabs, thus capturing the tabs in the second, locked tab position. The legs of the tree stand are each broadened in width at their fold-up pivot point and then tapered to a narrower width at their distal ends. This taper provides an improved center of gravity about the shaft of the tree trunk, thus reducing the tendency for the tree to tip over. The legs are sufficiently elongated to provide good balance in their extended, operative position.

It is an object of the present invention to provide an improved, collapsible tree stand.

It is another object of this invention to provide a collapsible tree stand that is rugged and that also easily folds up for storage.

It is yet another object of the invention to provide a collapsible tree stand that has an improved center of gravity in order to prevent the tree from tipping over.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the figures.

DESCRIPTION OF THE PREFERRED EMBODIMENT

Generally speaking, the invention features a collapsible tree stand. The fold-up design of the tree stand provides a solid, compact construction having an improved center of gravity and a vertical collapsing profile for ease of storage. The legs of the tree stand are each broadened in width at their fold-up pivot point and then tapered to a narrower width at their distal ends. This taper provides an improved center of gravity about the shaft of the tree trunk, thus reducing the tendency of the tree to tip over. The legs are sufficiently elongated to provide good balance in their extended position.

Figure 1:
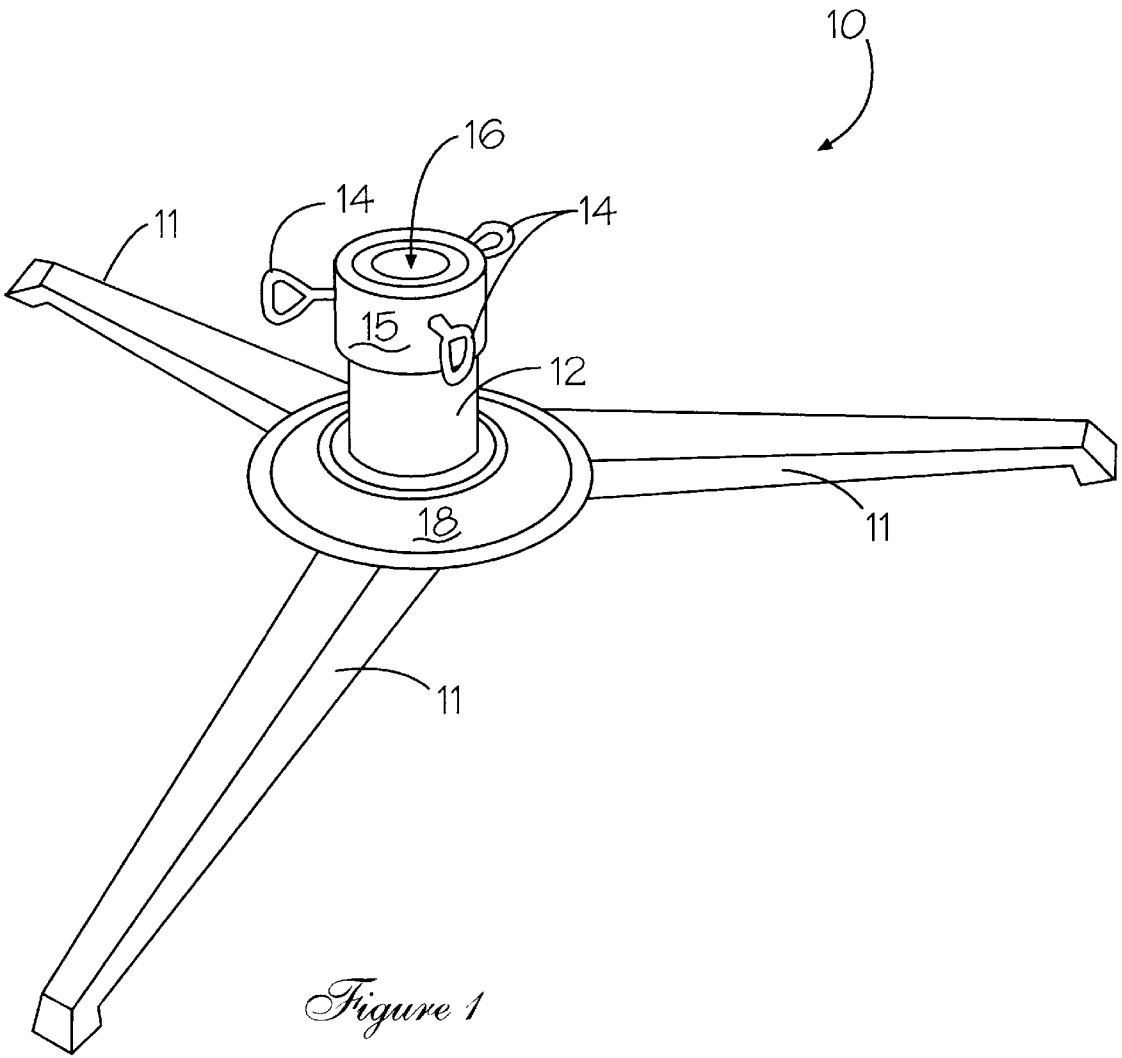
FIG. 1 illustrates a perspective view of a first, three-legged embodiment of the improved tree stand of this invention, shown in its expanded, operative position.
Figure 2:
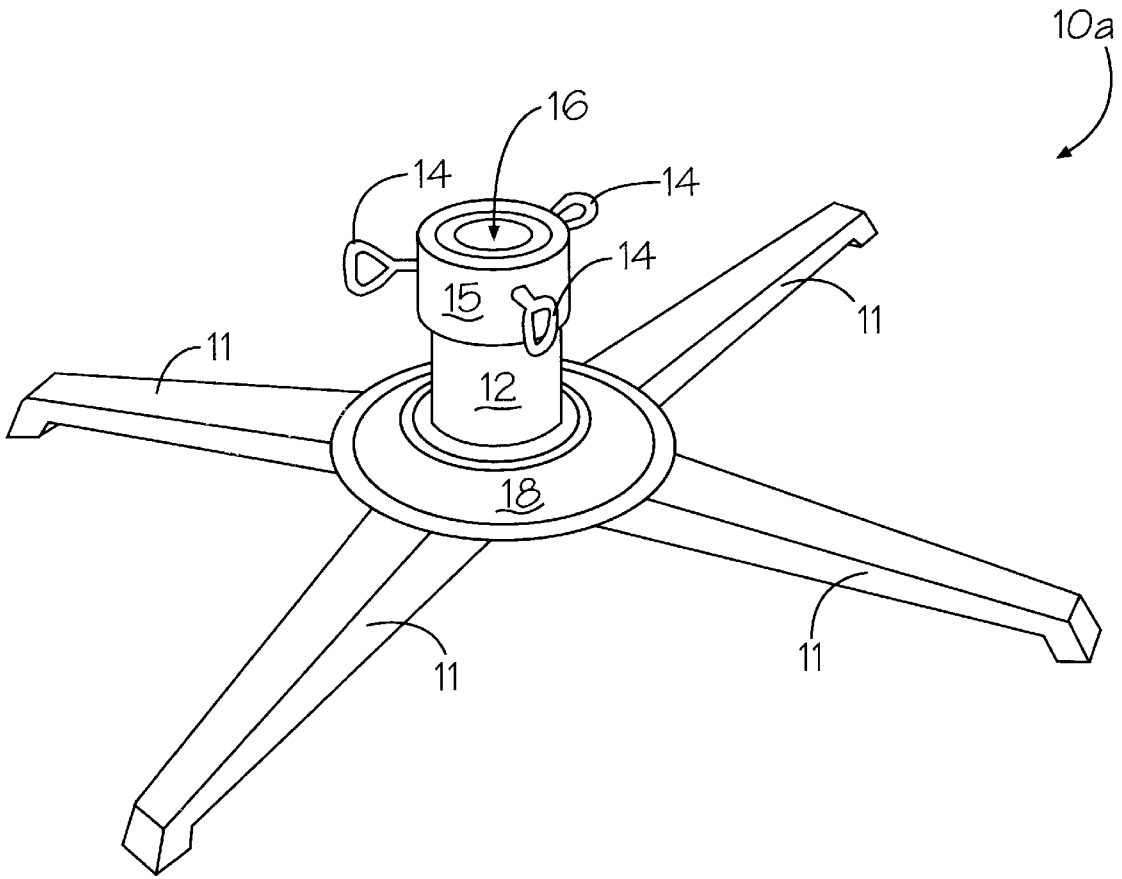
FIG. 2 depicts a perspective view of a second, four-legged embodiment of the improved tree stand of the invention, illustrated in its expanded, operative position.

Now referring to FIG. 1, a first embodiment of a three-legged tree stand 10 in accordance with the teachings of this invention, is illustrated in its leg-extended, operative position. The invention features both the three-legged tree stand 10 and a second embodiment featuring a four-legged tree stand 10*a,* as depicted in FIG. 2. For all intended purposes, the respective tree stands 10 and 10*a* are constructed and function in a similar fashion. Therefore, only the second, four-legged embodiment need be described in detail.

Figure 7A:
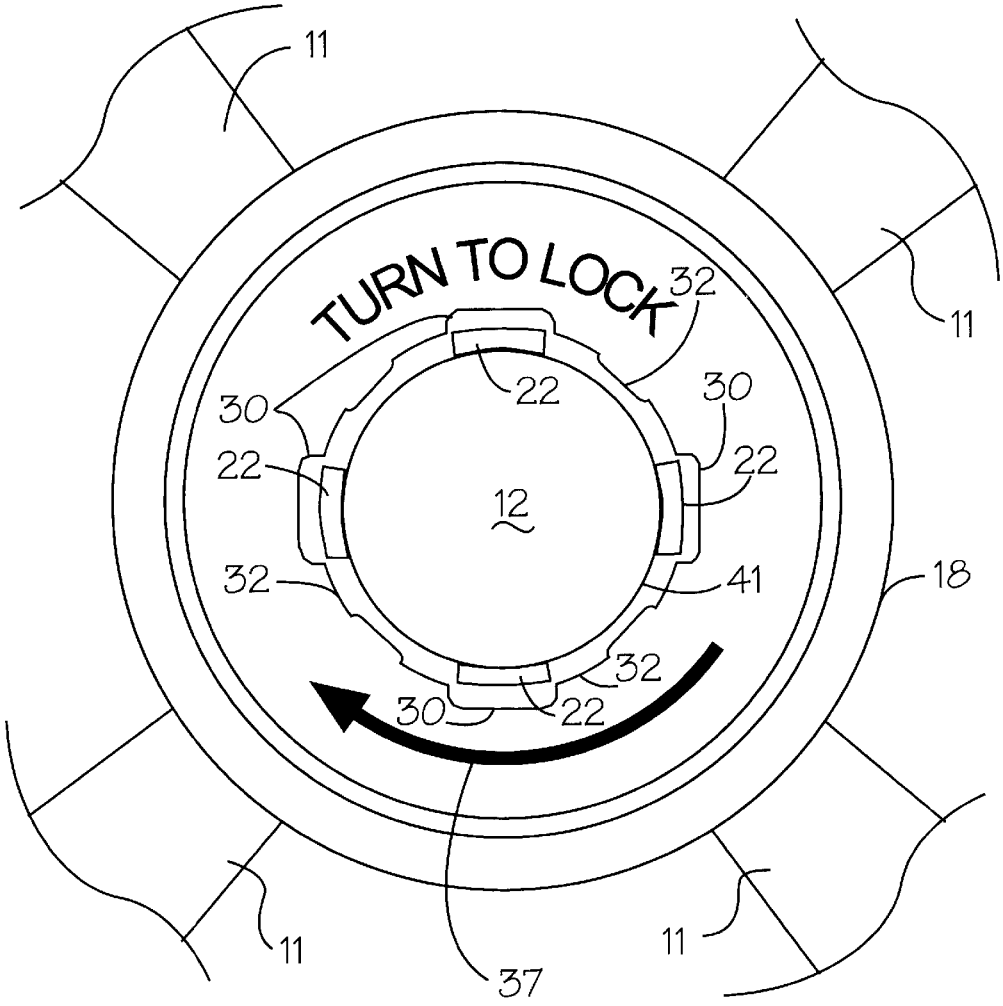
FIGS. 7*a* and 7*b* illustrate enlarged top views of the locking collar of the four-legged tree stand of FIG. 2, in respective unlocked and locked positions.

The legs 11 of each first and second tree stand embodiment are pivotally attached to a hollow cylindrical base 12, as will be explained hereinafter with reference to FIGS. 3 and 4. A collar 18 disposed about the cylindrical base 12 locks the legs 11 in their extended, operative position, as will be explained hereinafter with respect to FIGS. 7*a,* 7*b,* 8*a,* and 8*b*.

Figure 5:
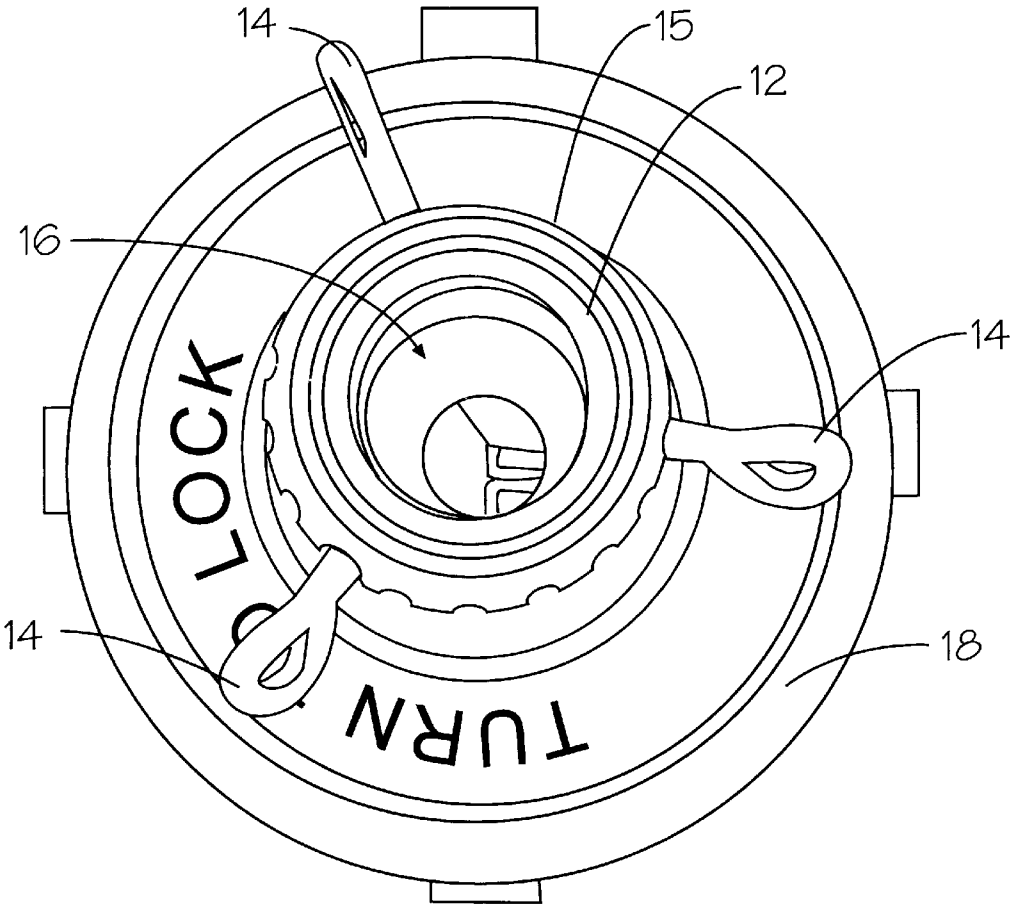
FIG. 5 depicts a top view of the second, four-legged tree stand embodiment illustrated in FIG. 3.

Referring to FIG. 5, the hollow, cylindrical base 12 supports a severed trunk of a tree (not shown). A number of looped thumbscrews 14 are equally spaced about, and are threaded through, the thickened top portion 15 of the cylindrical base 12, in order to capture an inserted, severed, tree trunk, which is inserted into the hollow portion 16.

Figure 3:
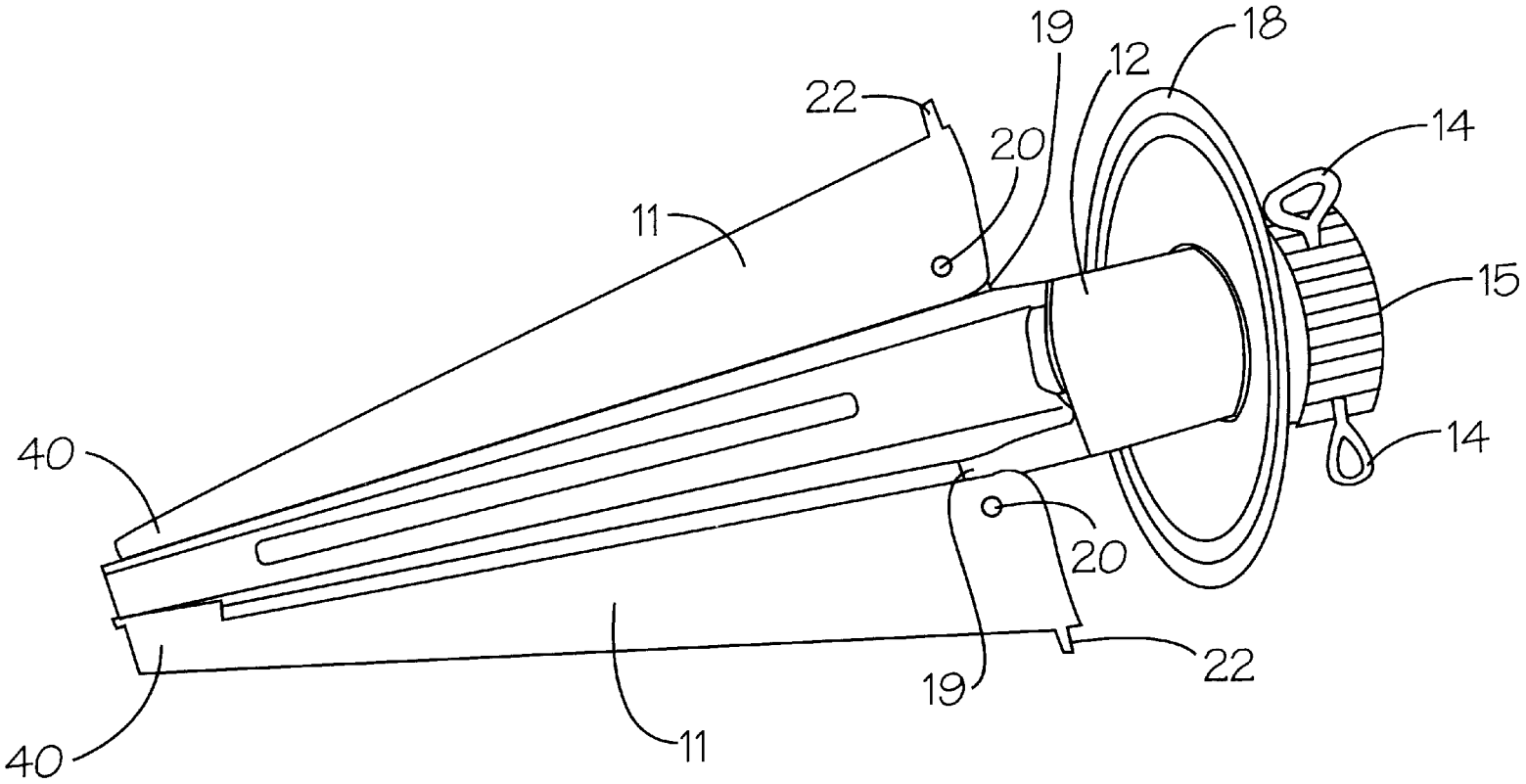
FIG. 3 shows a perspective view of the second, four-legged embodiment of the tree stand of FIG. 2, depicted in a collapsed, folded up position.
Figure 4:
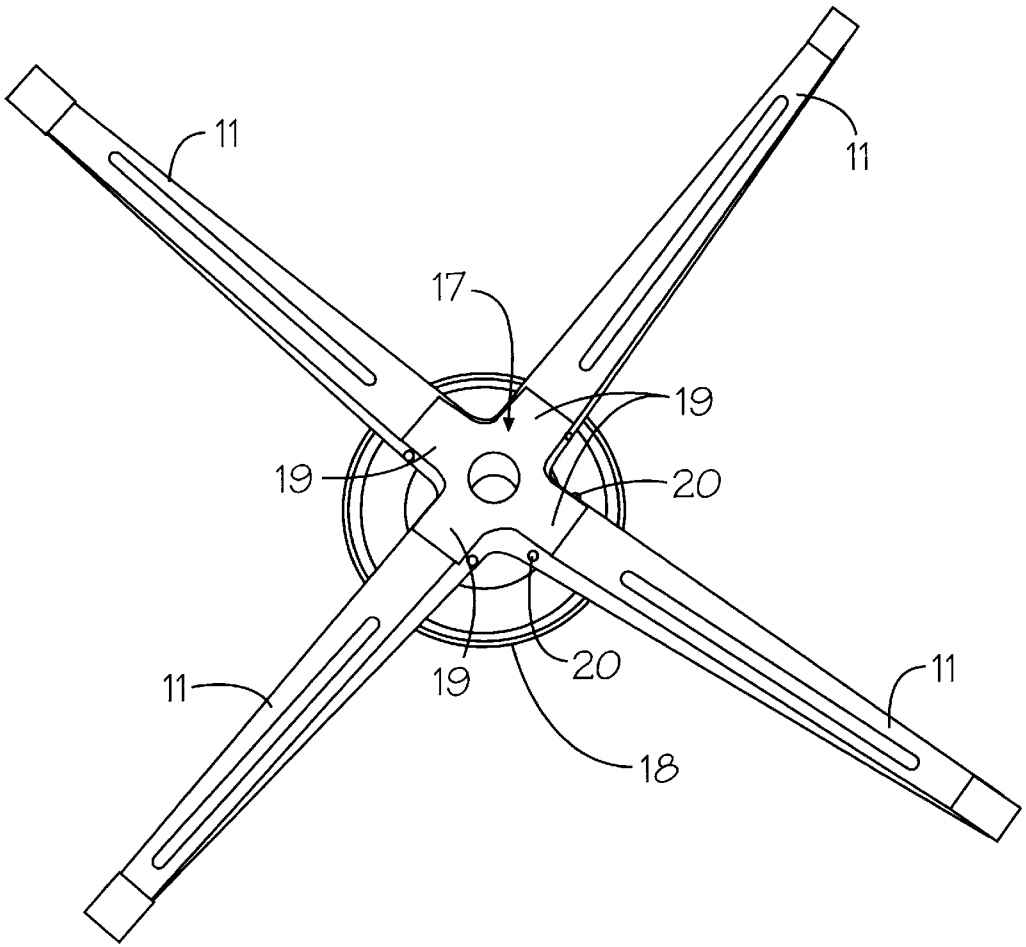
FIG. 4 illustrates a bottom view of the second, four-legged tree stand embodiment shown in FIG. 2.
Figure 6:
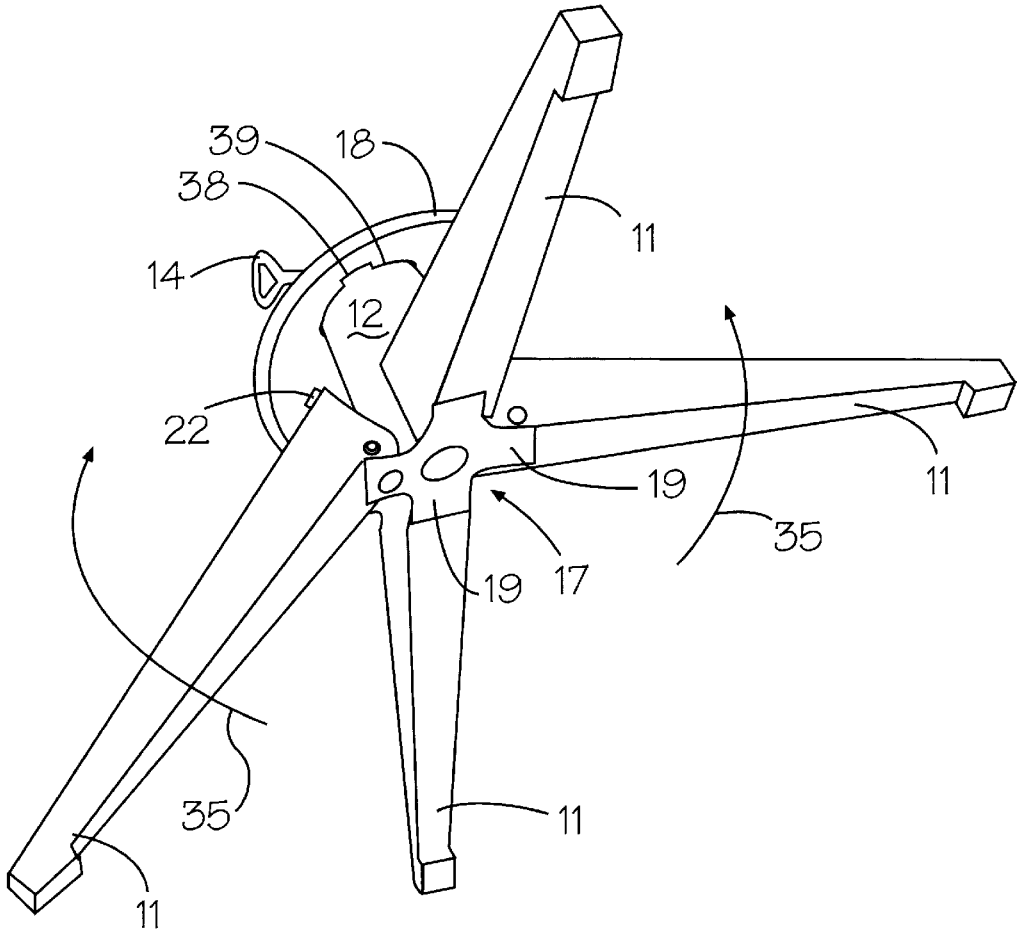
FIG. 6 shows a bottom perspective view of the four-legged tree stand depicted in FIG. 2.

Referring to FIGS. 3, 4, and 6, a bottom portion 17 of the cylindrical base 12 comprises three or four integrally spaced flange members 19. The flange members 19 are disposed in a triangular or cross pattern about the bottom of the base 12 (i.e., at one hundred twenty or ninety degrees around the bottom). The legs 11 are each pivotally pinned to a respective flange member 19 by pivot pins 20. Each of the legs 11 comprises a locking tab 22 (FIG. 3) disposed opposite its pivot pin 20. The stand 10 is pivotally operative between the first, fold-up vertical position (FIG. 3) and the second, horizontally extended, operative position, as shown in FIGS. 1 and 2.

In the first, fold-up position (used for storage purposes), each locking tab 22 is projected outwardly a short distance from the base 12 in a radial manner. In the extended, operative position, each of the locking tabs 22 fits flush with the outer cylindrical surface 41 (FIGS. 7*a* and 7*b*) of the hollow, cylindrical base 12. The cylindrical collar 18 is free to move in translation along the longitudinal length of the base 12 in order to ride over and capture the locking tabs 22, when the legs are in the second, horizontally extended position, shown in FIGS. 1 and 2. In the captured state, the locking tabs 22 prevent the legs 11 from pivoting back to their first, fold-up position.

Figure 7B:
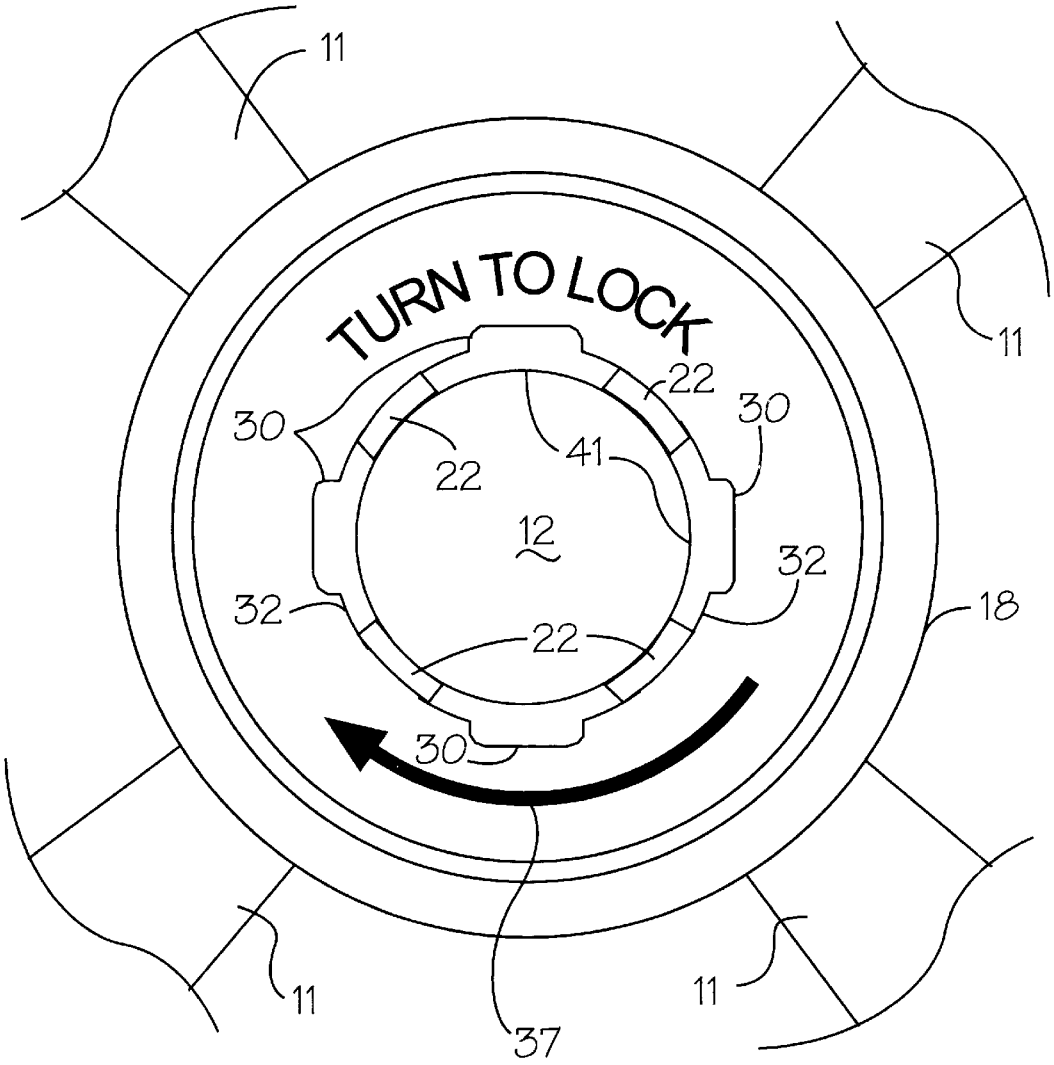
Figure 8A:
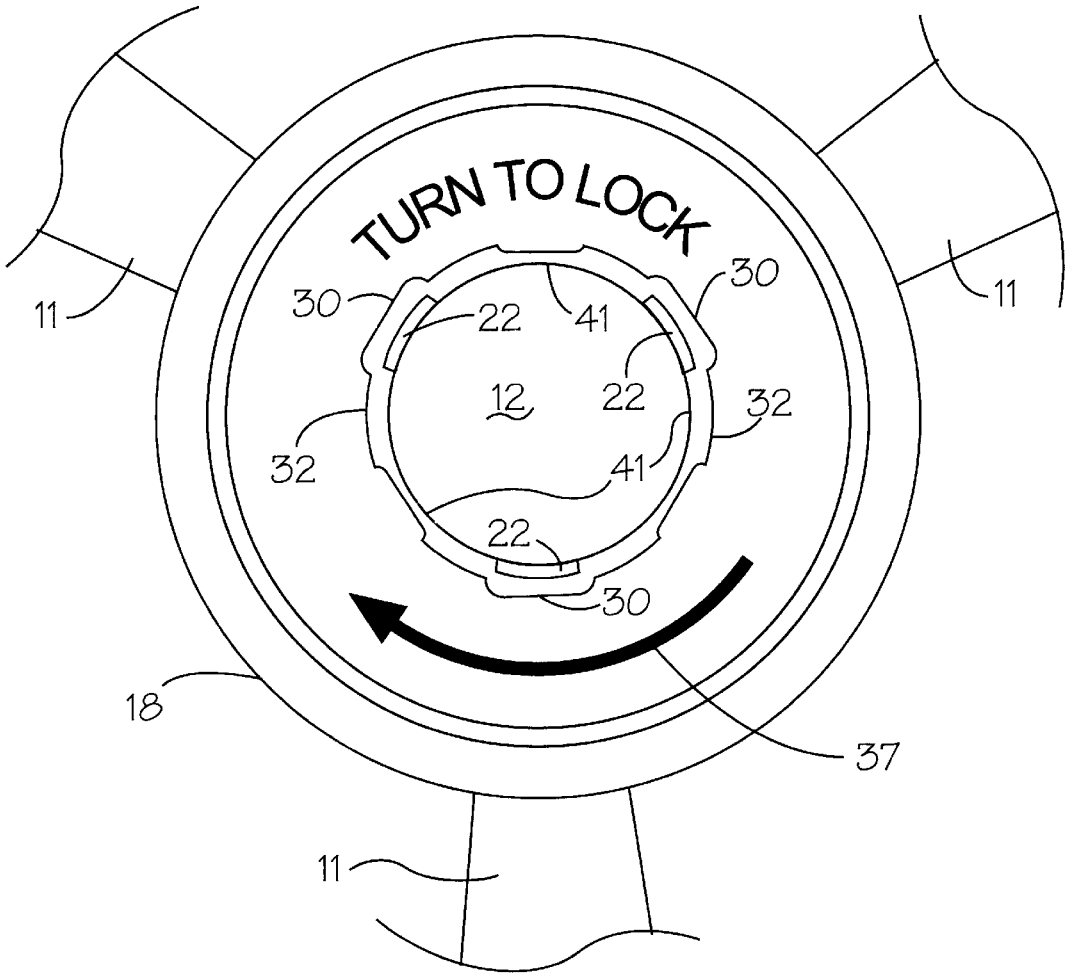
FIGS. 8*a* and 8*b* depict enlarged top views of the locking collar of the three-legged tree stand of FIG. 1, in respective unlocked and locked positions.
Figure 8B:
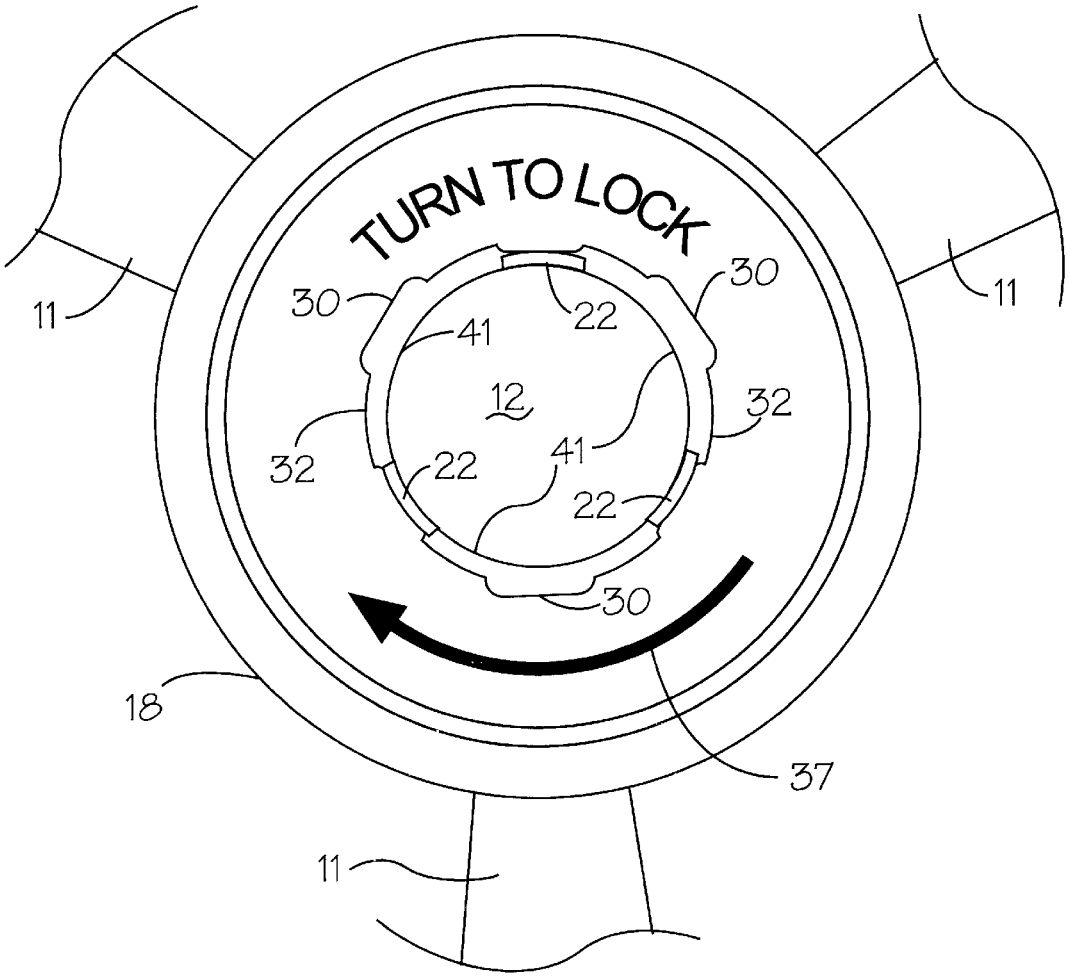

The cylindrical collar 18 contains apertures 30 and adjacent lands 32 that are disposed about an inner, annular surface adjacent the outer surface 41 of the cylindrical base 12. The cylindrical collar 18 is free to rotate (arrow 37) about the cylindrical base 12 between a first, unlocked tab position (FIGS. 7*a* and 8*a*), and a second, locked tab position (FIGS. 7*b* and 8*b*).

Referring to FIG. 6, the legs 11 are pivoted (arrow 35) to their extended, operative position to form a stable cross or triangular patterned pedestal, after which a tree is inserted into the hollow portion 16 of the cylindrical base 12. In this position, the collar 18 is vertically placed over the locking tabs 22, and the tabs 22 enter the inner apertures 38 in the collar 18. The collar 18 is then turned approximately a sixteenth of a full turn to bring the lands 39 in contact with the tabs 22, thus capturing the tabs 22 in the second, locked tab position.

Referring again to FIG. 3, the legs 11 of the tree stand are each broadened in width at the point of their pivot pin 20, and then tapered to a narrower width at their distal end 40, which provides a larger profile about the base. This taper provides an improved center of gravity about the base and the shaft of the tree trunk, thus reducing the tendency for the tree to tip over. The legs are sufficiently elongated to provide good balance in their extended, operative position.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A collapsible tree stand comprising:

a base for receiving, supporting, and capturing a tree, said base having an outer surface;

at least three elongated legs, each of said legs having a locking tab, and each of said legs being pivotally attached to said base, said at least three elongated legs being pivotal from a first, fold-up position about said base to a second, extended, operative position, said at least three elongated legs having both a profile and center of gravity that increase from said distal end of said elongated legs towards said base to prevent the supported and captured tree from tipping over; and a collar movably disposed upon said base for locking said at least three elongated legs in said second, extended, operative position, said collar comprising means, adjacently disposed against said outer surface of said base, defining apertures and lands for respectively capturing and locking each locking tab.

2. The collapsible tree stand in accordance with claim 1, wherein said base comprises a hollow cylinder.

3. The collapsible tree stand in accordance with claim 2, wherein said collar is movable in rotation and translation about said hollow cylinder.

4. The collapsible tree stand in accordance with claim 1, wherein said means defining apertures and lands of said collar is disposed in an annular ring about said base.

5. A collapsible tree stand, comprising:

a cylindrical, hollow base for receiving, supporting, and capturing a tree, said base having an outer surface;

four elongated legs pivotally attached to said base, each of said four elongated legs having a locking tab, and each of said four elongated legs being pivotal from a first fold-up position about said base to a second, extended, operative position, said four elongated legs having both a profile and a center of gravity that increase from said distal end of said four elongated legs towards said base to prevent the supported and captured tree from tipping over; and a collar movably disposed upon said base for locking said four elongated legs in said the second, extended, operative position, said collar comprising means, adjacently disposed against said outer surface of said base, defining apertures and lands for respectively capturing and locking each locking tab.

6. The collapsible tree stand in accordance with claim 5, wherein said cylindrical, hollow base comprises a plurality of screw-threaded fasteners disposed about said base for securing a trunk of a tree.

7. The collapsible tree stand in accordance with claim 5, wherein said collar is movable in rotation and translation about said hollow cylinder.

8. The collapsible tree stand in accordance with claim 5, wherein said means defining apertures and lands of said collar is disposed in an annular ring about said base.

9. The collapsible tree stand in accordance with claim 5, wherein said cylindrical, hollow base comprises a plurality of screw-threaded fasteners disposed about said base for securing a trunk of a tree.

* * * * *

UNITED STATES PATENT AND TRADEMARK OFFICE

CERTIFICATE OF CORRECTION

PATENT NO. : 6,572,068 B1
APPLICATION NO. : 09/973172
DATED : June 3, 2003
INVENTOR(S) : Chung Wai Cheng It is certified that error appears in the above-identified patent and that said Letters Patent is hereby corrected as shown below:

Title page, item (12), the name of the inventor reads "Wai", should read -- Cheng --.

Title page, item (75), the name of the inventor reads "Cheng Chung Wai", should read -- Chung Wai Cheng --.

Signed and Sealed this

Twenty-fifth Day of March, 2008

JON W. DUDAS
*Director of the United States Patent and Trademark Office*